with a temperature selected from a specified range and with limited rates of temperature increase and of temperature decrease, the control unit has a temperature selector 34 connected to one input of a mode selector 36. The other input to the selector is the signal from the temperature sensor 12. By way of example, the temperature selector 50 can include a voltage divider that is manually set to the specified elevated temperature, or to ambient, by way of the manual control 16 of FIG. 2.

The mode selector functions to produce an error signal proportioned to the difference between the selector signal and the sensor signal it receives, and to apply the error signal to one of two integrators 38 and 40 depending on the relative polarity of the two signals. The mode selector accordingly can be constructed with a differential amplifier 42 having complementary outputs, each of which feeds a different integrator. Diodes 44 and 46 remove negative outputs, so that each integrator receives only a positive signal. The time constant of the integrator 38 limits the rate of temperature increase, and the integrator 40 has a time constant to limit the rate of temperature decrease, to the values specified above. Each integrator can be constructed to operate with a time constant that can be selectively adjusted within the specified limit.

A driver amplifier 42 receives the integrated signal from whichever integrator is operative, and in turn operates a power supply 44 to supply electrical exitation to the heater from a power source, which typically is a 60-cycle 110-volt supply.

The foregoing electrical system for practicing the invention is illustrative of those known in the art and which can be constructed using conventional skills well known to those practiced in this art.

It will thus be seen that the objects set forth above, among those made apparent from the preceding description, are efficiently attained. Since certain changes may be made in the above constructions and in carrying out the above techniques without departing from the scope of the invention, it is intended that all matter contained in the above description or shown in the accompanying drawings be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described the invention, what is claimed as new and secured by letters patent is:

1. Cortical temperature — elevating apparatus for imposing a selected elevated body-differential cortical temperature to a person, said apparatus comprising A. controllable thermal means for the localized heatinhg of the head of a person, B. sensor means for sensing the temperature of the person's head, and C. control means connected with said sensor means to receive a temperature-responsive signal and controlling in response thereto said thermal means to apply a temperature selected from the range between 38° and 50° C to the person's head, with a maximum rate of temperature increase below 1.0° C per minute.

2. Apparatus according to claim 1 incuding a head garment mounting said thermal means for relatively high heat transfer with a wearer's head.

3. Apparatus according to claim 2 in which said sensor means includes a temperature sensor mounted with said garment for disposition in relatively close thermal contact with the wearer's head.

4. Apparatus according to claim 2 in which said sensor means includes a tympanic membrane temperature sensor.

5. Apparatus according to claim 1 further characterized in that said control means includes means for controlling said thermal means to regulate the rate of temperature decrease from said selected elevated temperature to the person's present normal level at a maximum rate below 0.5° C per minute.

6. Apparatus according to claim 1 further characterized in that said control unit includes means for limiting the rate of temperature increase to 0.8° C per minute.

7. Apparatus according to claim 6 further characterized in that said control unit includes means for limiting the rate of temperature decrease from an elevated level to normal, to 0.4° C per minute.

8. A method for enhancing human cerebral functioning comprising the steps of A. selectively elevating the cortical temperature by imposing a selected elevated body-differential temperature to the person's head, B. monitoring the head temperature during at least the interval of said temperature-elevation, and C. controlling the elevation of the head temperature in response to said monitoring to a temperature selected from the range between 38° C and 50° C, and controlling the rate of temperature increase to be less than 0.8° C per minute.

9. A method as defined in claim 8 in which said controlling step further includes the step of controlling the rate of temperature decrease from said selected temperature to the person's present normal level to a maximum rate of 0.4° C per minute.

* * * * *

TOBACCO BASED SMOKING MATERIAL

This application is a continuation of my co-pending application Ser. No. 332,115 filed Feb. 13, 1973 now abandoned.

This invention relates to the production of an improved smoking material from tobacco.

In our U.S. Pat. No. 3,545,448, it is proposed to replace at least a portion of the tobacco in smoking mixtures by a modified carbohydrate material produced by subjecting carbohydrate to a catalysed degradation at 100°–250° C until the weight of the degraded material is less than 90% of the weight of the original carbohydrate.

It has now been found that catalysed thermal degradation of tobacco also produces beneficial results.

According to the invention a process for the manufacture of an improved material suitable for smoking mixtures comprises subjecting tobacco to a catalysed degradation process at a temperature of at least 100° C, suitably 100° to 300° C and preferably 100° to 250° C, especially 160° to 250° C until the weight of degraded material is less than 90% of the weight of the original tobacco. Desirably the weight of the degraded material should not be less than 70% of the weight of the original tobacco.

All kinds of tobacco may be used in the process of the invention, including cigarette tobaccos such as flue-cured Virginia (FCV) tobacco, and stronger tobaccos such as Burley and Rustica tobaccos.

The catalyst used in the process may be any substance which accelerates the thermal degradation of tobacco or lowers its thermal degradation temperature. Acidic substances are especially effective, preferred catalysts being strong acids and salts of strong acids with weak bases. Mineral acids e.g. sulphuric, phosphoric and hydrochloric acids may be used, and weak base salts which are of value include ammonium sulphate, diammonium hydrogen phosphate, ferric chloride and especially ammonium subphamate. Alkaline substances are also effective catalysts, for example alkali hydroxides e.g. sodium hydroxide, and alkali salts of weak acids e.g. sodium carbonate. When alkaline catalysts are used, however, the degraded material should preferably be washed substantially free of catalyst before it is used for smoking.

Preferably the catalyst is used in amounts ranging from 1 to 20%, preferably 3 to 8% by weight of the tobacco.

The process of the invention may be carried out with the tobacco in any convenient form for example as leaf, powder or sheet. The possible presence of other substances which are inert under the degradation conditions is not excluded. Thus neutral salts and inert binders may be present if desired.

In the process all volatile matter is permitted to escape from the zone in which thermal degradation takes place. The process appears to be degradative in its effect upon the cellulose and other carbohydrate constituents of the tobacco, evolving water and other volatile matter.

Duration of the process will depend upon the temperature, the catalyst, the physical state of the tobacco and the extent of the effect desired.

The process changes the colour of the tobacco to dark brown-black. Quite surprisingly, however, the thermally degraded material, when smoked, possesses enhanced tobacco flavour, indicating that the flavourants present have unexpected stability under the conditions used.

When heated in absence of any catalyst tobacco may lose weight and by continuing the heating a residue weighing less than 90% of the original tobacco may be produced. Such residues do not have improved smoke flavour compared with the original tobacco and they are definitely inferior in smoke flavour to the materials made by the present process. It is within the scope of the invention to heat tobacco in the absence of any catalyst and then to continue heating in the presence of a catalyst.

A further benefit from the process of the invention is that there is a reduction in formaldehyde delivery in the smoke from the products, compared with the untreated tobacco. Formaldehyde is known to be a severe ciliatoxic component in tobacco smoke.

When an acid catalyst, such as sulphuric acid, has been used in the process of the invention, it is advantageous to neutralise any residual acidity in the thermally degraded material by adding ammonia.

The thermally degraded material produced by the process of the invention may, if desired, be compounded with other materials which are normal constituents of smoking mixtures, for example, tobacco, carbohydrates, modified carbohydrates, especially thermally degraded carbohydrates (and in particular thermally degraded cellulose) made by the process of our U.S. Pat. No. 3,545,448, or other smoke-producing materials and as desired any of the modifying agents commonly used in smoking mixtues.

Thus for example smoking mixtures containing thermally degraded material made by the process of the present invention may also contain glow-promoting catalyst, materials to improve ash coherence or colour, nicotine, flavourants, humectants, medicaments or inorganic fillers.

As glow-promoting catalysts for ensuring "fire-holding capacity", alkali metal compounds are preferred.

As materials to improve the ash, salts of ammonia, alkali metals or alkaline earth metals can be used and of these, salts of magnesium, calcium or ammonium are preferred. Bentonite is an especially effective ash cohesion agent.

Numerous beneficial flavouring materials may be included in the mixture. These include tobacco extracts, organic esters, essential oils, menthol, tonka bean or vanillin.

Glycerol and glycols, such as, for example, ethylene glycol and di-, tri- and tetra-ethylene glycol are convenient humectants.

Desirably, inorganic fillers are incorporated in order to control the burning rate of the mixture. By balancing ions which accelerate combustion against ions which retard combustion, in the manner described in our U.K. Pat. No. 1,299,296 (Application No. 13860/70) acceptable combustion rates may be achieved even when large amounts (e.g. 40% or more by weight) of filler are incorporated. Carbonates, particularly calcium and magnesium carbonates are valuable fillers, especially when used in combination to produce an acceptable burning rate. Porous inert fillers may facilitate combustion, imparting a more open texture to the mixture and thereby facilitating access of oxygen.

It is convenient for smoking mixtures to simulate tobacco and the thermally degraded material is therefore preferably prepared in sheet form and, when re- The film was shredded and made into cigarettes. A panel of expert smokers was unanimously of the opinion that these cigarettes showed improved tobacco flavour compared with similar cigarettes which contained ball milled Burley tobacco which had not been thermally degraded. The ordinary Burley tobacco cigarette had only a slight tobacco/woody flavour compared to the distinct tobacco flavour of the cigarette containing thermally degraded Burley tobacco.

EXAMPLE 5

This example illustrates the superior tobacco flavour of the thermally degraded FCV tobacco compared to FCV tobacco which had been heated under similar conditions without a catalyst.

4.0 Parts of sodium carboxymethyl cellulose was dissolved in 160 parts of water with stirring and an aqueous solution of 5.6 parts of glycerol, 2.0 parts of potassium citrate and 1.6 parts of citric acid in 40 parts of water was added. A dry mixture consisting of 4.0 parts of calcium carbonate and 22.8 parts of a material (ground to pass a 120 B.S. Sieve) prepared by heat treating flue cured Virginian tobacco rag without a catalyst at a temperature of 220°–225° C for 20–25 minutes resulting in a 20% weight loss, was then added. The resultant slurry was stirred for at least 1 hour then cast on a drier to give a film with a dry basis weight of 48–52 grams per sq.meter.

The film was shredded and made into cigarettes. Flavour assessment of these cigarettes by a panel of experts compared with equivalent cigarettes containing the thermally degraded FCV tobacco (see Example 2) showed that the panellists unanimously preferred the cigarettes containing the catalysed heat treated tobacco because of its superior tobacco flavour.

EXAMPLE 6

This example illustrates the superior tobacco flavour of the thermally degraded Burley tobacco compared to Burley tobacco which has been similarly heated in the absence of a catalyst.

Burley tobacco was heated without a catalyst at a temperature of 220°–225° C for 20–25 minutes to give a material which had lost 13.4% of its weight. This material was ground into a powder and formulated as follows:

4.0 parts of sodium carboxymethyl cellulose were dissolved in 160 parts of water with stirring and an aqueous solution of 5.6 parts of glycerol, 2.0 parts of potassium citrate and 1.6 parts of citric acid in 40 parts of water added. A dry mixture consisting of 4.0 parts of calcium carbonate and 22.8 parts of the above heat treated Burley tobacco rag was then added. The resultant slurry was stirred for at least 1 hour then cast on a drier to give a film with a dry basis weight of 48–52 grams per sq.meter.

The film was shredded and made into cigarettes. Flavour assessment of these cigarettes by a panel of experts with equivalent cigarettes containing powdered thermally degraded Burley tobacco prepared as described in Example 4 showed a unanimous preference for the latter cigarettes on account of their superior tobacco flavour. The cigarettes containing the Burley tobacco heated without a catalyst had essentially the flavour of burning cellulose and very little tobacco flavour.

EXAMPLE 7

95 Parts of flue-cured Virginia tobacco were sprayed with 5 parts of ammonium sulphamate in 95 parts of water. The tobacco was then air dried and heated at 180° C for 6 hours to give a weight loss of 20%. The product was ground to pass a 120 B.S. Sieve.

4.0 parts of sodium carboxymethyl cellulose was dissolved in 160 parts of water with stirring and an aqueous solution of 4.8 parts of glycerol, 2.0 parts of potassium citrate and 1.6 parts of citric acid in 40 parts of water was added. A dry mixture consisting of 4.0 parts of calcium carbonate and 22.8 parts of the heat-treated FCV tobacco prepared as described in the previous paragraph was then added. The resultant slurry was stirred for 1 hour, then cast on a drier to give a film with a dry basis weight of 48–52 gram per sq.meter. The film was then shredded and made into cigarettes.

Assessment of these cigarettes compared with similar cigarettes containing ball-milled FCV tobacco by a panel of experts showed that the tobacco character of the smoke was increased in the cigarettes containing the ammonium sulphamate catalysed heat-treated Virginian tobacco.

We claim:

1. A process for the manufacture of an improved material suitable for smoking mixtures, comprising subjecting tobacco to a catalyzed degradation process at a temperature between about 100° to about 300° C until the weight of degraded material is less than 90% but not less than about 70% of the weight of the original tobacco, wherein said catalyzed degradation is carried out in the presence of a catalyst which accelerates the thermal degradation of said tobacco or lowers the thermal degradation temperature, said catalyst selected from the group consisting of strong acids, salts of strong acids with weak bases, alkali salts of weak acids and alkali hydroxides whereby the degraded tobacco material possesses enhanced tobacco flavour as compared to untreated tobacco.

2. Process according to claim 1 wherein the temperature is 100° to 250° C.

3. Process according to claim 1 wherein the temperature is 160° to 250° C.

4. Process according to claim 3 wherein acidity from the use of a strong acid is neutralised by adding ammonia.

5. Process according to claim 1 wherein the catalyst used is an acidic substance.

6. Process according to claim 5 wherein the catalyst is a strong acid or a salt of a strong acid with a weak base.

7. Process according to claim 6 wherein the catalyst is sulphuric acid.

8. Process according to claim 6 wherein the catalyst is ammonium sulphamate.

9. Process according to claim 1 wherein the amount of catalyst is from 1 to 20% by weight of the tobacco.

10. Process according to claim 1 wherein the amount of catalyst is from 3 to 8% by weight of the tobacco.

11. Process according to claim 1 applied to tobacco stalks or finely powdered tobacco material.

12. Thermally degraded tobacco made by the process of claim 1.

13. Thermally degraded tobacco according to claim 12 formulated into a sheet.

14. Thermally degraded tobacco according to claim 13 formulated into a sheet which contains another smoke-producing material, a glow-promoting catalyst, a material to improve ash coherence or colour, nicotine, flavourant, humectant, medicament or filler.

15. Thermally degraded tobacco formulated into a sheet according to claim 13, containing at least 40% of filler in which ions accelerating combustion are balanced against ions retarding combustion to provide an acceptable combustion rate.

16. Thermally degraded tobacco according to claim 12 formulated into a sheet with the aid of a binding agent.

17. A process for the manufacture of an improved material suitable for smoking mixtures, comprising subjecting tobacco to a catalyzed degradation process at a temperature in excess of 100° C until the weight of the degraded material is less than 90% but not less than about 70% of the weight of the original tobacco, wherein said catalyzed degradation is carried out in the presence of a catalyst which accelerates the thermal degradation of said tobacco or lowers the thermal degradation temperature whereby the degraded tobacco material possesses enhanced tobacco flavour as compared to untreated tobacco.

18. Process according to claim 17 wherein the temperature is between about 100° C to about 300° C.

* * * * *

UNITED STATES PATENT OFFICE

CERTIFICATE OF CORRECTION

Patent No. 4,002,176 Dated January 11, 1977

Inventor(s) Robert Craig Anderson

It is certified that error appears in the above-identified patent and that said Letters Patent are hereby corrected as shown below:

IN THE HEADING:

Please insert:

--[30] Foreign Application Priority Data
March 2, 1972 Great Britain.....9808/72 -- after "[21] Appl. No.: 497,036".

Signed and Sealed this
Twenty-first Day of June 1977

[SEAL]

*Attest:*

RUTH C. MASON
*Attesting Officer*

C. MARSHALL DANN
*Commissioner of Patents and Trademarks*